US010173295B2

(12) United States Patent
Kitamura et al.

(10) Patent No.: US 10,173,295 B2
(45) Date of Patent: Jan. 8, 2019

(54) MACHINING DEVICE WITH A DETACHABLY MOUNTED SPINDLE UNIT

(71) Applicant: JTEKT CORPORATION, Osaka-shi, Osaka (JP)

(72) Inventors: Kenichiro Kitamura, Kashiba (JP); Shinsaku Kozakai, Kashiwara (JP); Fumikazu Hirakawa, Kashiba (JP); Naoya Okubo, Kizugawa (JP)

(73) Assignee: JTEKT CORPORATION, Osaka-shi (JP)

( * ) Notice: Subject to any disclaimer, the term of this patent is extended or adjusted under 35 U.S.C. 154(b) by 60 days.

(21) Appl. No.: 15/274,818

(22) Filed: Sep. 23, 2016

(65) Prior Publication Data

US 2017/0095898 A1 Apr. 6, 2017

(30) Foreign Application Priority Data

Oct. 5, 2015 (JP) ..... 2015-197393

(51) Int. Cl.

| | |
|---|---|
| ***B24B 5/307*** | (2006.01) |
| ***B24B 5/22*** | (2006.01) |
| *B24B 5/18* | (2006.01) |
| *B24B 5/10* | (2006.01) |

(52) U.S. Cl.

CPC ..... *B24B 5/307* (2013.01); *B24B 5/22* (2013.01); *B24B 5/10* (2013.01); *B24B 5/185* (2013.01)

(58) Field of Classification Search

CPC .... B24B 5/06; B24B 5/10; B24B 5/18; B24B 5/185; B24B 5/22; B24B 5/307; B24B 41/062

See application file for complete search history.

(56) References Cited

U.S. PATENT DOCUMENTS 2,127,210 A * 8/1938 Dunbar ..... B24B 47/06 29/37 A
3,601,930 A * 8/1971 Robillard ..... B23Q 15/12 451/1
3,803,772 A * 4/1974 Klar ..... B24B 49/16 451/10
3,842,543 A * 10/1974 Hohler ..... B24B 5/185 451/246
5,707,726 A * 1/1998 Ohtaka ..... B24B 5/18 399/279
5,766,057 A * 6/1998 Maack ..... B24B 5/35 451/194

(Continued)

FOREIGN PATENT DOCUMENTS

JP 2014-240094 A 12/2014

*Primary Examiner* — Timothy V Eley
(74) *Attorney, Agent, or Firm* — Oliff PLC

(57) ABSTRACT

A machining device includes: a spindle unit including a spindle that rotates a workpiece; and a device base having the spindle unit mounted thereon. The spindle unit includes upper and lower rolls that rotate the workpiece by contacting the workpiece, upper and lower rotary shafts that rotate integrally with the upper and lower rolls and serves as the spindle, and a support member that supports the workpiece. The device base has mounted thereon the spindle unit, a motor that rotates the upper and lower rotary shafts, and a grindstone to be brought into contact with the workpiece. The spindle unit is detachably mounted on the device base.

21 Claims, 10 Drawing Sheets

(56) References Cited

U.S. PATENT DOCUMENTS

| | | | | |
|---|---|---|---|---|
| 7,223,159 | B2 * | 5/2007 | Tschudin | B24B 5/307 451/182 |
| 2002/0006764 | A1 * | 1/2002 | Hanisch | B23Q 1/52 451/1 |
| 2004/0048551 | A1 * | 3/2004 | Tschudin | B24B 5/307 451/5 |
| 2016/0121459 | A1 | 5/2016 | Mizuura et al. | |
| 2017/0106488 | A1 * | 4/2017 | Sasakura | B24B 41/02 |

* cited by examiner

CONVENTIONAL

MACHINING DEVICE WITH A DETACHABLY MOUNTED SPINDLE UNIT

INCORPORATION BY REFERENCE

The disclosure of Japanese Patent Application No. 2015-197393 filed on Oct. 5, 2015 including the specification, drawings and abstract, is incorporated herein by reference in its entirety.

BACKGROUND OF THE INVENTION

1. Field of the Invention

The present invention relates to machining devices that machine a workpiece.

2. Description of the Related Art

Among machining devices that grind a workpiece of a cylindrical object such as a workpiece to be used as an inner ring or an outer ring of a rolling bearing, a machining device is known which uses a two-roll, one-shoe spindle mechanism as one type of spindle mechanism that rotates a workpiece when grinding of the workpiece is carried out (see, e.g., Japanese Patent Application Publication No. 2014-240094 (JP 2014-240094 A)). As shown in FIG. 10, the two-roll, one-shoe spindle mechanism has an upper roll 91 that contacts a workpiece W from above, a lower roll 92 that contacts the workpiece W from below, and a shoe 93 that prevents the workpiece W from falling off.

The use of such a two-roll, one-shoe spindle mechanism is advantageous in that a workpiece can be loaded relatively quickly and idle time during operation can be reduced (the net operation rate can be improved). However, the two-roll, one-shoe spindle mechanism has the following disadvantages. In the two-roll, one-shoe spindle mechanism, components of the spindle mechanism such as the rolls are frequently required to be replaced or adjusted in position when the bearing number (specifications) of workpieces is changed. This work is complicated and increases the operation stop time of the machining device for changeover. As a result, the operation rate of the machining device is reduced, which results in reduction in productivity.

A machining device (grinding machine) described in JP 2014-240094 A includes a position adjustment mechanism and an angle adjustment mechanism as a configuration that carries out changeover between workpieces. The position adjustment mechanism changes the positions in the up-down direction of the upper and lower rolls. The angle adjustment mechanism changes the tilt angles of the central axes of the upper and lower rolls with respect to the horizontal direction.

In order to change the bearing number of workpieces (changeover), the position adjustment mechanism can adjust the positions of the upper and lower rolls 91, 92 and the angle adjustment mechanism can adjust the angle of the upper roll 91 by using a master workpiece. However, these adjustments need be made every time the bearing number is changed. In the case of machining many kinds of workpieces with different bearing numbers in small quantities, the operation of the machining device is stopped every time changeover is carried out, which may significantly reduce the operation rate of the machining device. Depending on the machining device, adjustment of a stopper for an upper frame (not shown) that is integral with the upper roll 91, adjustment of the position of a proximity switch for the rolls, etc. are required in addition to the above adjustments. This further increases the operation stop time.

SUMMARY OF THE INVENTION

It is one object of the present invention to provide a machining device whose operation can be quickly resumed in the case of carrying out changeover between workpieces.

According to one aspect of the present invention, a machining device includes: a spindle unit including a spindle that rotates a workpiece or a spindle that rotates a member for machining the workpiece; and a device base, on which the spindle unit is mounted. In the machining device, the spindle unit is detachably mounted on the device base.

BRIEF DESCRIPTION OF THE DRAWINGS

The foregoing and further features and advantages of the invention will become apparent from the following description of example embodiments with reference to the accompanying drawings, wherein like numerals are used to represent like elements and wherein.

DETAILED DESCRIPTION OF EMBODIMENTS

Figure 1:
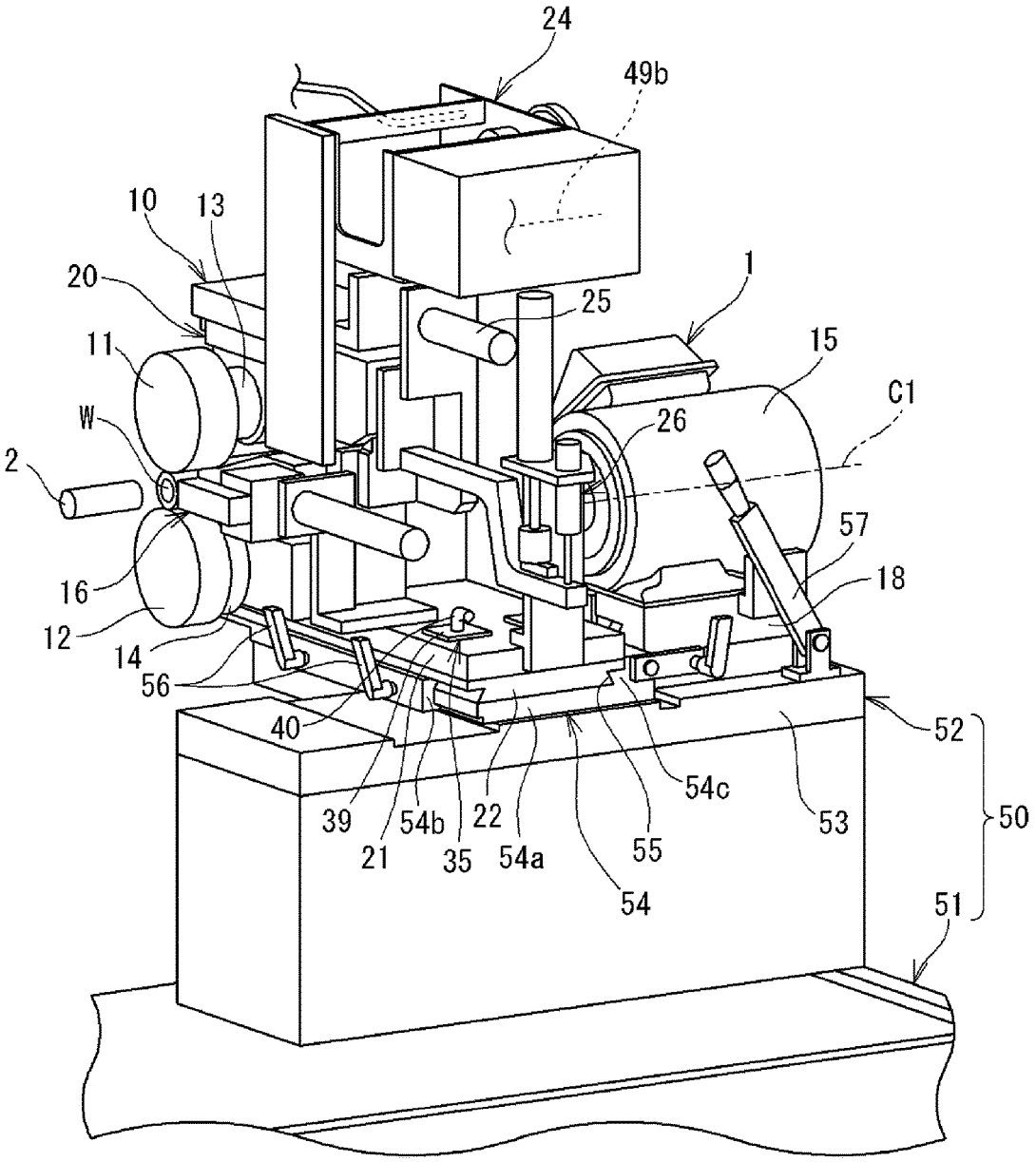
FIG. 1 is a perspective view showing a part of an embodiment of a machining device according to the present invention.

An embodiment of the present invention will be described below with reference to the accompanying drawings. FIG. 1 is a perspective view showing a part of an embodiment of a machining device 1 according to the present invention. The machining device 1 is a device (grinding machine) that grinds a workpiece W.

The machining device 1 rotates the workpiece W about its centerline and presses a grindstone 2 against the workpiece W to grind the workpiece W. The machining device 1 includes a spindle unit 10 and a device base 50.

The spindle unit 10 is mounted on a base platform 52 of the device base 50. The spindle unit 10 has a frame body 20 assembled from a plurality of members. Components (rolls 11, 12, a connector unit 24, etc. described below) of the spindle unit 10 are supported by the frame body 20.

The spindle unit 10 has an upper roll 11 and a lower roll 12 which serve as rolls that rotates the workpiece W. The spindle unit 10 further has an upper rotary shaft 13 and a lower rotary shaft 14. The upper rotary shaft 13 rotates integrally with the upper roll 11, and the lower rotary shaft 14 rotates with the lower roll 12.

Each of the upper rotary shaft 13 and the lower rotary shaft 14 has a pulley, not shown, attached to its other end.

Each of these pulleys is coupled to a pulley 17 (see FIG. 2) via a drive belt (not shown). The pulley 17 is attached to an output shaft 15*a* of a motor 15. As the motor 15 is rotated, the upper and lower rolls 11, 12 are rotated accordingly. These rolls 11, 12 contact the workpiece W, whereby the workpiece W can be rotated.

The spindle unit 10 further has a support member (shoe) 16 that supports the workpiece W. The support member 16 prevents the workpiece W located between the rolls 11, 12 from falling off. The spindle unit 10 of the present embodiment is therefore a spindle unit including a two-roll, one-shoe spindle mechanism.

The frame body 20 of the spindle unit 10 includes a base plate 21 in its lower part. The base plate 21 is a member that is placed horizontally over the base platform 52. A guided portion 22 is disposed on a lower surface of the base plate 21. The guided portion 22 is shaped to project so as to correspond to the shape of a dovetail groove 55 formed in the device base 50 described below.

The device base 50 has a device stand 51 fixed to a floor and the base platform 52 fixed to the device stand 51. The base platform 52 has a support plate 53 disposed horizontally in its upper part. The spindle unit 10 and the motor 15 are mounted on the support plate 53. A grindstone unit including the grindstone 2 and a drive unit (not shown) that drives the grindstone 2 is a separate unit from the spindle unit 10. In the present embodiment, the grindstone unit is mounted on the device stand 51. However, the grindstone unit may be mounted on the base platform 52.

The base platform 52 of the device base 50 has a rail portion 54 and a clamp 56. The rail portion 54 has the dovetail groove 55 and is fixed to the support plate 53. The longitudinal direction of the dovetail groove 55 matches the front-rear direction of the machining device 1. In the machining device 1, the direction parallel to the centerline C1 of the motor 15 is defined as the "right-left direction," and the horizontal direction perpendicular to the right-left direction is defined as the "front-rear direction." The direction perpendicular to the right-left direction and the front-rear direction is referred to as the up-down direction (vertical direction).

The rail portion 54 has a rail plate 54*a* and a guide 54*b*. The rail plate 54*a* is fixed to the support plate 53, and the guide 54*b* can be displaced in the right-left direction with respect to the rail plate 54*a*. The dovetail groove 55 extends between a sidewall 54*c* of the rail plate 54*a* and the guide 54*b* so that the width in the right-left direction of the dovetail groove 55 increases as closer to a bottom surface, or a lower surface, of the dovetail groove 55. The clamp 56 of the present embodiment is formed by a clamp bolt and can clamp the guide 54*b* to the rail plate 54*a*. The clamp 56 has a function to unclamp the guide 54*b* from the rail plate 54*a*.

As described above, the spindle unit 10 has the guided portion 22 at its lower surface, and the guided portion 22 is shaped to project so as to correspond to the shape of the dovetail groove 55. With the guide 54*b* being unclamped from the rail plate 54*a* by the clamp 56, the guided portion 22 can move in the front-rear direction along the rail portion 54, namely the spindle unit 10 including the guided portion 22 can move in the front-rear direction along the rail portion 54.

With the guided portion 22 (spindle unit 10) being located at a predetermined position on the rail portion 54, the clamp 56 clamps the guide 54*b* to the rail plate 54*a*. The guided portion 22 (spindle unit 10) can thus be fixed to the rail portion 54 (base platform 52). The guided portion 22 (spindle unit 10) can be released from the rail portion 54 (base platform 52) by unclamping the guide 54*b* from the rail plate 54*a* by the clamp 56.

Figure 2:
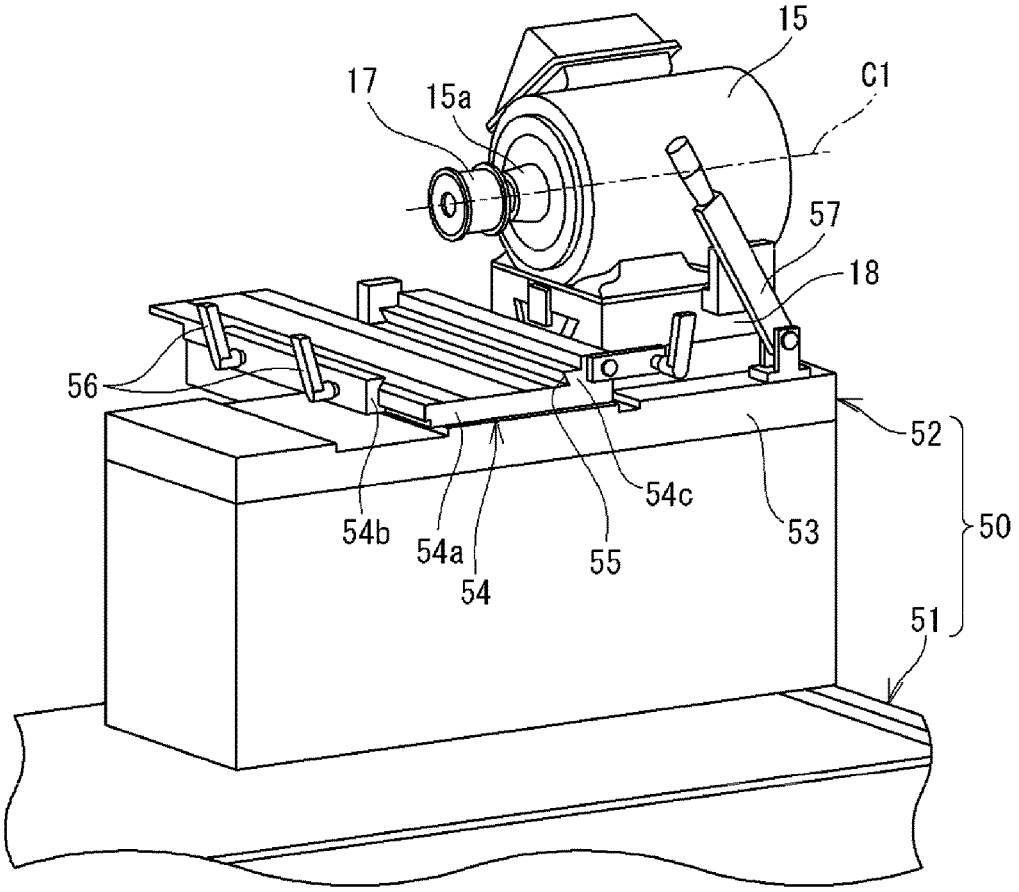
FIG. 2 is a perspective view showing a device base having a spindle unit detached therefrom.

With the above configuration, the grindstone unit including the spindle unit 10, the motor 15, and the grindstone 2 is mounted on the device base 50. The motor 15 is a drive source that rotates the upper rotary shaft 13 and the lower rotary shaft 14. The grindstone 2 contacts the workpiece W. In order to machine the workpiece W, the spindle unit 10 is fixed at a predetermined position on the device base 50 (rail portion 54) (the state shown in FIG. 1). The spindle unit 10 can be detached from the device base 50 by releasing the spindle unit 10 from the device base 50 (see FIG. 2). The spindle unit 10 can thus be detachably mounted on the device base 50. The component to be detached from the device base 50 is the spindle unit 10, and as shown in FIG. 2, the motor 15 remains on the device base 50 (base platform 52). The drive belt (not shown) that connects the pulley 17 of the motor 15 to the upper rotary shaft 13 (see FIG. 1) and the lower rotary shaft 14 is removed when the spindle unit 10 is detached from the device base 50. In the present embodiment, in order to prevent interference between the spindle unit 10 and the motor 15 (pulley 17) when the spindle unit 10 is moved along the rail portion 54, a motor base 18 having the motor 15 mounted thereon can be withdrawn by operating a lever 57.

Figure 3:
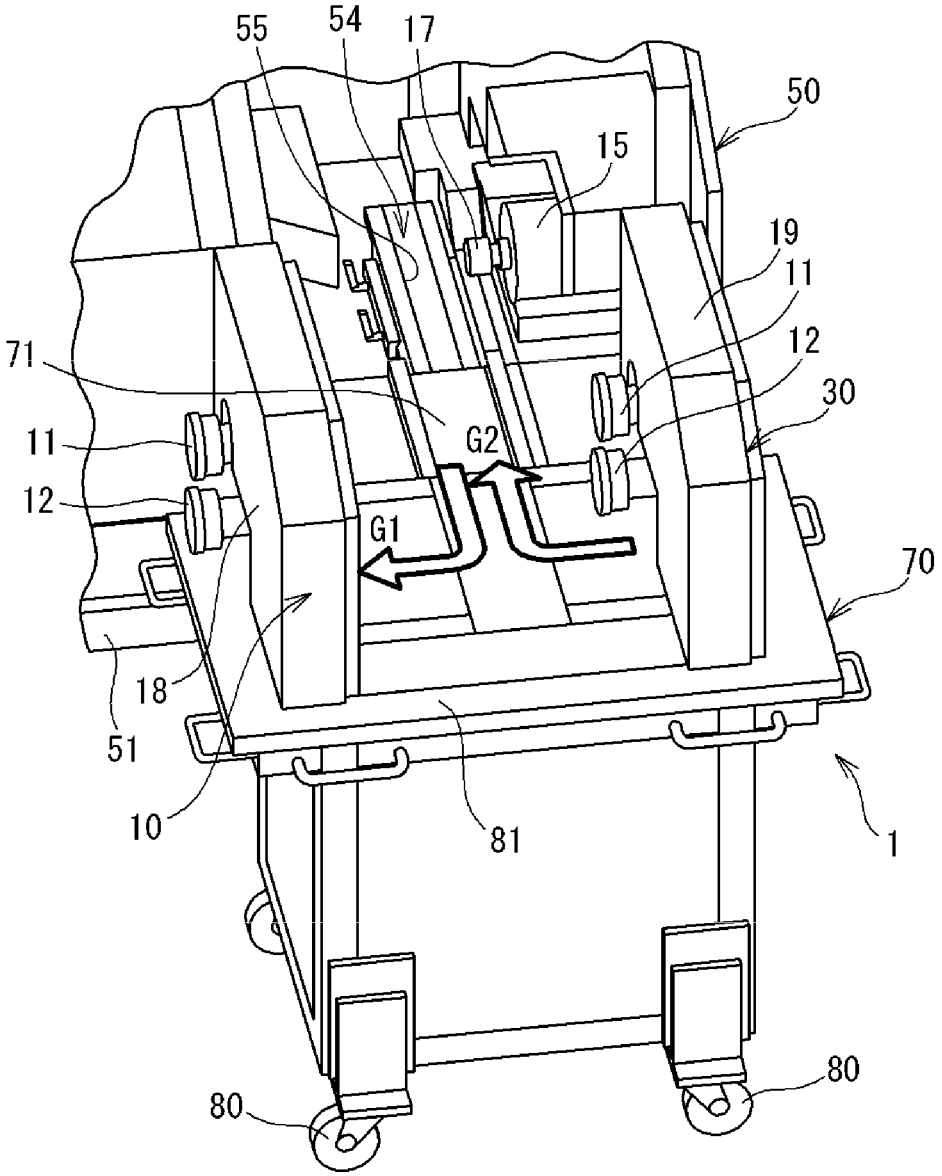
FIG. 3 is a perspective view illustrating changeover that is carried by using a changeover cart.

As shown in FIG. 3, the spindle unit (first spindle unit) 10 detached from the device base 50 is placed on a changeover cart 70 (arrow G1 in FIG. 3). A second spindle unit 30 that has been placed on the changeover cart 70 can be placed on the device base 50 (rail portion 54) as shown by arrow G2 in FIG. 3. In FIG. 3, each of the spindle units 10, 30 has a cover 19 attached thereto.

The machining device 1 of the present embodiment further includes a lifting mechanism 35 (see FIG. 1) in order to facilitate such attachment and detachment (replacement) of the spindle unit 10 to and from the device base 50. The lifting mechanism 35 is a mechanism that makes the guided portion 22 float within the dovetail groove 55 by air. In the present embodiment, the spindle unit 10 is provided with the lifting mechanism 35. That is, the lifting mechanism 35 is provided on the base plate 21 of the frame body 20 of the spindle unit 10. The lifting mechanism 35 is placed in the four corners of the base plate 21 having a rectangular shape. The device base 50 is provided with an air supply unit (not shown) that generates pressurized air for the lifting mechanism 35. The air supply unit is connected to the lifting mechanism 35 by an air pipe.

Figure 4:
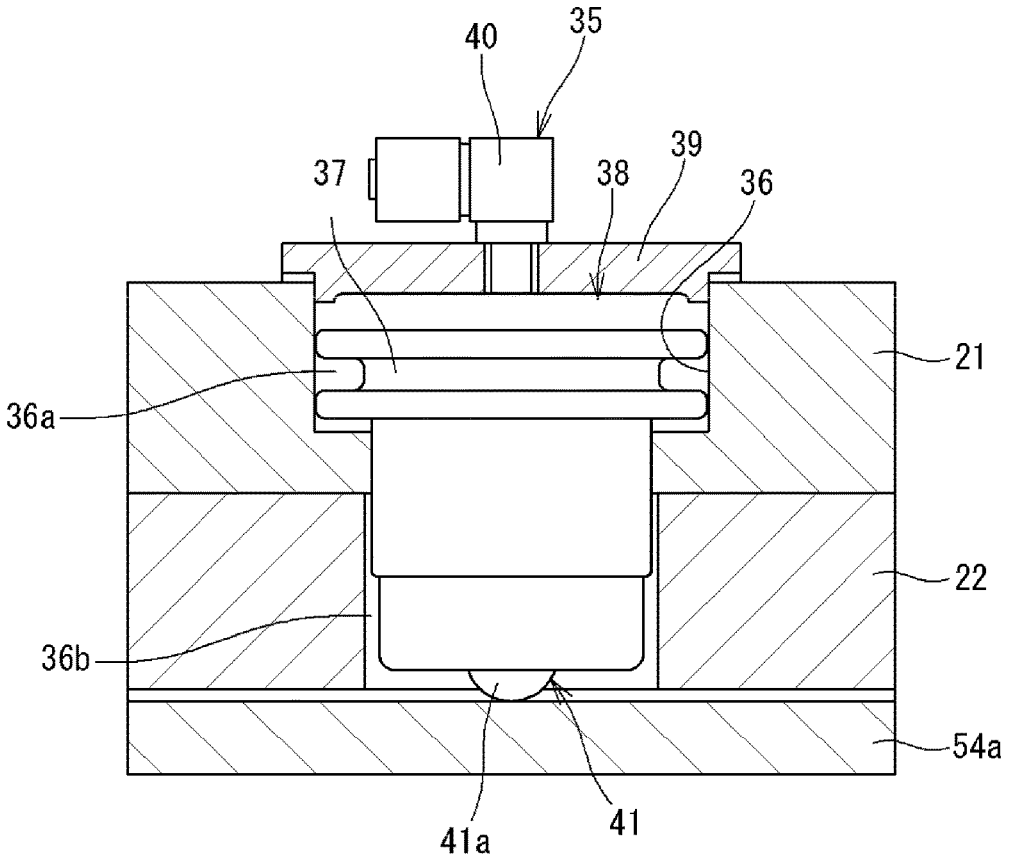
FIG. 4 is a sectional view of a lifting mechanism.

The configuration of the lifting mechanism 35 will be specifically described. As shown in FIG. 4, the base plate 21 and the guided portion 22 located on the lower surface of the base plate 21 have a through hole 36 extending therethrough in the up-down direction. A lift-up head 37 (hereinafter referred to as the "head 37") is disposed in the through hole 36 so as to be movable in the up-down direction. The through hole 36 has an enlarged space portion 36*a* and a small space portion 36*b*. The enlarged space portion 36*a* is an upper part of the through hole 36 and the small space portion 36*b* is a lower part of the through hole 36. A portion between the head 37 and the through hole 36 is sealed in the enlarged space portion 36*a*. A lid 39 is placed over the through hole 36 to seal the through hole 36. Air can be supplied to a space 38 created between the lid 39 and the head 37. This air is supplied from the air pipe, not shown, via a nipple elbow 40 attached to the lid 39. A ball support portion 41 is attached to a lower part of the head 37. The ball support portion 41 has a ball element 41*a* that can roll on the rail plate 54*a* that forms the dovetail groove 55.

When air is supplied to the space 38, the head 37 is moved downward and the ball support portion 41 in the lower part of the head 37 contacts and presses an upper surface of the rail plate 54*a*. Since pressurized air is supplied, the guided portion 22 is made to float from the rail plate 54*a* by the pressure of the pressurized air. The ball support portion 41 can thus support the lifted spindle unit 10 including the floating guided portion 22. Namely, the spindle unit 10 can float from the rail plate 54*a*. In this state, the ball support portion 41 can be in rolling contact with the rail plate 54*a*.

The lifting mechanism 35 thus has a mechanism of an air cylinder using the head 37 as an air cylinder head. Moreover, the lifting mechanism 35 has the ball support portion 41 in the lower part of the head 37. The lifting mechanism 35 can make the guided portion 22 float within the dovetail groove 55 (see FIG. 1) by air. The ball support portion 41 can support the floating guided portion 22 while being in rolling contact with the rail plate 54*a* of the rail portion 54. With the lifting mechanism 35, the spindle unit 10 can be easily moved along the rail portion 54. This further facilitates replacement of the spindle unit 10.

As described above, the spindle unit 10 can be attached to and detached from the device base 50 (see FIGS. 1 and 2). The spindle unit 10 has a sensor 26 mounted thereon. The sensor 26 is an electrical device for control of the position of the upper roll 11 etc. with respect to the workpiece W. The device base 50 is provided with a power supply-side device 59 (see FIG. 5) for the sensor 26. Electrical wiring that connects the sensor 26 to the power supply-side device 59 has a connector structure J1. The power supply-side device 59 includes a power supply adapter, a control box, etc. for supplying electric power to the sensor 26 and receiving a signal from the sensor 26. The electrical device may be a device other than the sensor 26 or may further include a device other than the sensor 26.

Figure 5:
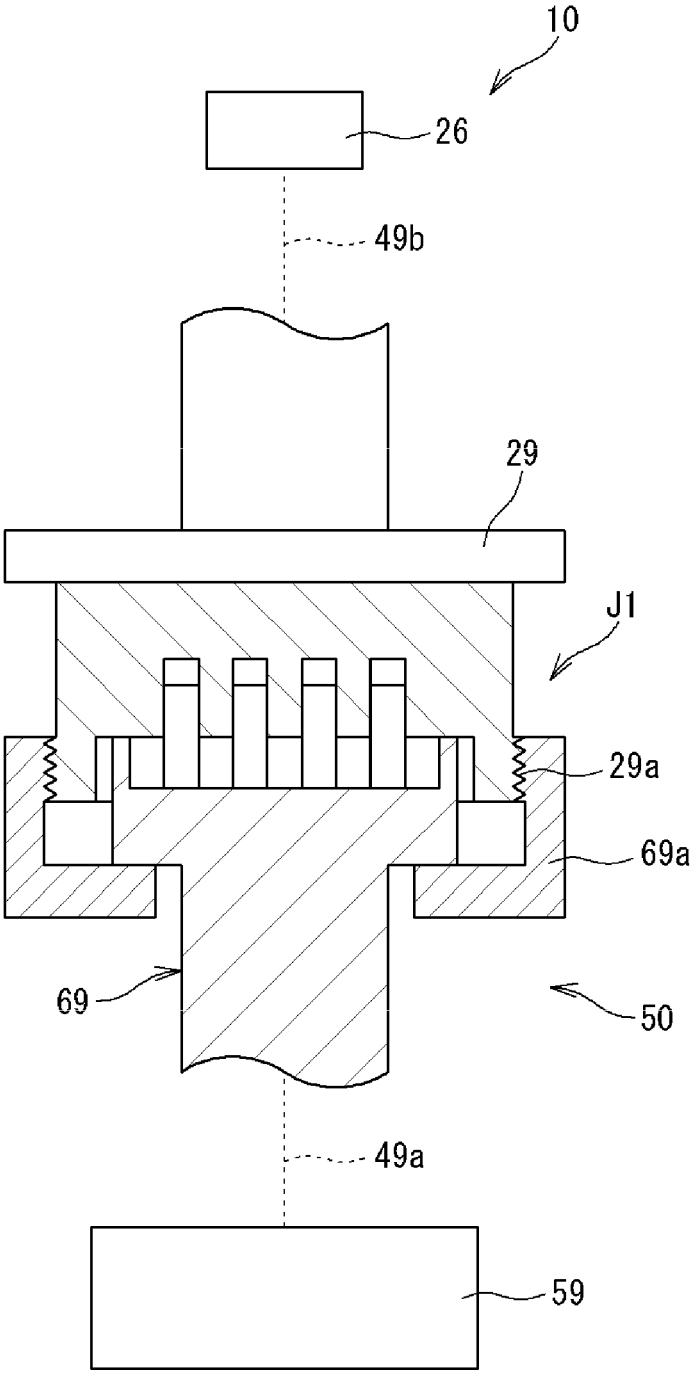
FIG. 5 is a schematic view illustrating a connector structure for electrical wiring.
Figure 6:
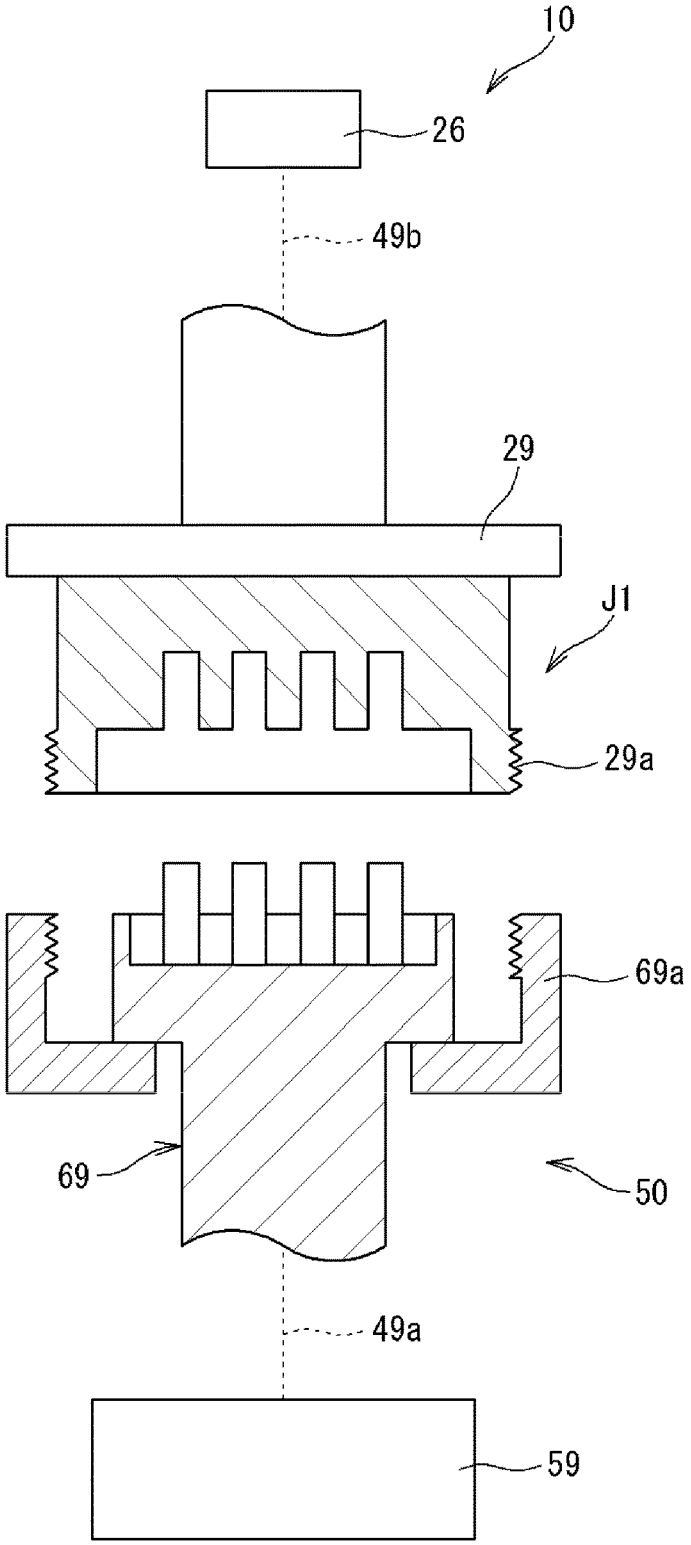
FIG. 6 is a schematic view illustrating the connector structure for the electrical wiring.

FIGS. 5 and 6 are schematic views illustrating the connector structure J1 for the electrical wiring 49*a*, 49*b*. The device base 50 has the power supply-side device 59 and a first connector (first electrical connector) 69. As described above, the power supply-side device 59 is a power supply adapter etc. The first connector 69 is connected to the power supply-side device 59 via an electrical wire 49*a*. The spindle unit 10 has a second connector (second electrical connector) 29 and the sensor 26 (electrical device). The second connector 29 can be attached to and detached from the first connector 69. The sensor 26 is connected to the second connector 29 via an electrical wire 49*b*. FIG. 5 shows the first and second connectors 69, 29 connected together. FIG. 6 shows the first and second connectors 69, 29 detached (disconnected) from each other.

In this connector structure J1, the first connector 69 is disconnected from the second connector 29 when the (first) spindle unit 10 is detached from the device base 50. When the second spindle unit 30 is mounted on the device base 50, the first connector 69 of the device base 50 is connected to the second connector 29 of the second spindle unit 30. These connectors 29, 69 are connected together by tightening a threaded member 69*a* of one connector 69 onto a threaded portion 29*a* of the other connector 29. The connectors 29, 60 can thus be easily connected to and disconnected from each other. With the connector structure J1, connection of the electrical wiring etc. for changeover between workpieces W can be performed with high workability.

Figure 7:
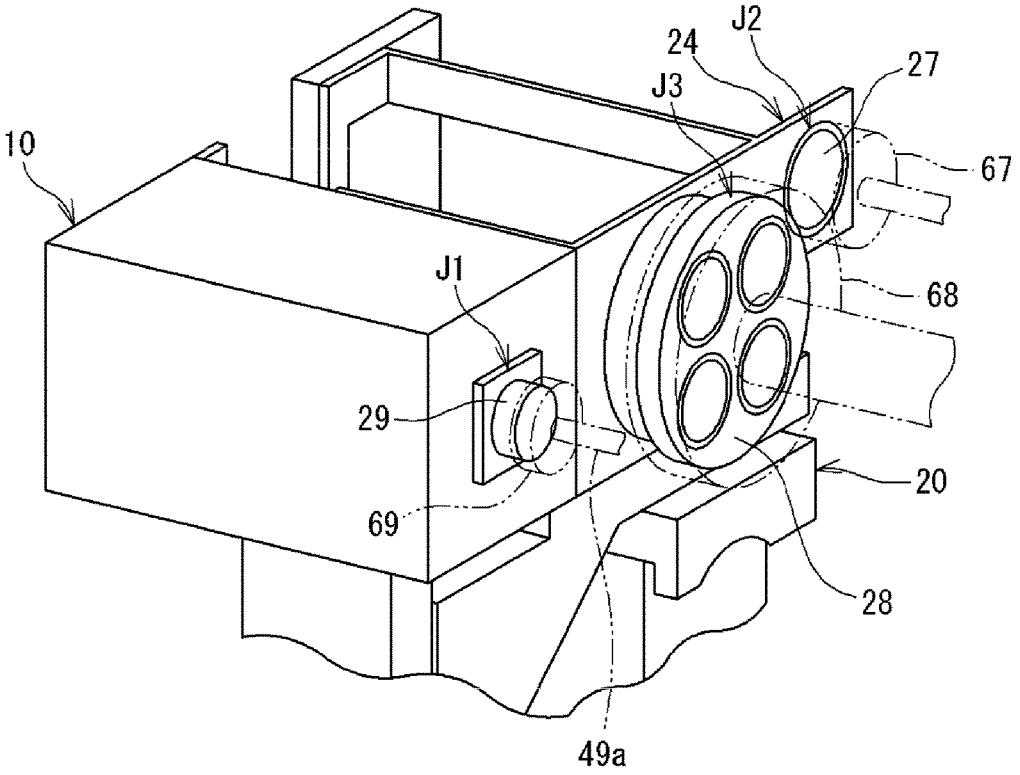
FIG. 7 is a schematic view of a connector unit mounted on the spindle unit.

As shown in FIG. 7, the second connector 29 of the spindle unit 10 is attached to the connector unit 24 disposed above the frame body 20. FIG. 7 is a schematic view of the connector unit 24 mounted on the spindle unit 10.

As described above, in the machining device 1 (see FIG. 1), the spindle unit 10 is provided with the lifting mechanism 35, whereas the device base 50 is provided with the air supply unit (not shown) that generates air flow to supply air to the lifting mechanism 35. The air pipe that connects the lifting mechanism 35 to the air supply unit has a connector structure J2 (see FIG. 7). The connector structure J2 has a connection structure similar to that shown in FIGS. 5 and 6 (although the connector structure J1 is for the electrical wiring and the connector structure J2 is for the air pipe). As shown in FIG. 7, the connector structure J2 has a pair of air connectors, namely a first connector (first air connector) 67 and a second connector (second air connector) 27, which can be attached to and detached from each other.

The spindle unit 10 (see FIG. 1) further has a hydraulic cylinder 25 mounted thereon. The hydraulic cylinder 25 applies a force that presses the upper roll 11 against the workpiece W. The device base 50 is provided with a hydraulic unit (not shown) that generates an oil pressure to supply hydraulic oil to the hydraulic cylinder 25. A hydraulic pipe that connects the hydraulic cylinder 25 to the hydraulic unit has a connector structure J3 (see FIG. 7). The connector structure J3 has a connection structure similar to that shown in FIGS. 5 and 6 (although the connector structure J1 is for the electrical wiring and the connector structure J3 is for the hydraulic pipe). As shown in FIG. 7, the connector structure J3 has a pair of hydraulic oil connectors, namely a first connector (first hydraulic oil connector) 68 and a second connector (second hydraulic oil connector) 28, which can be attached to and detached from each other.

As shown in FIG. 7, all of the second connectors 27, 28, 29 are provided on the connector unit 24 of the spindle unit 10. This further facilitates disconnection and connection of the first connectors 67, 68, 69 from and to the second connectors 27, 28, 29 between the spindle unit 10 and the device base 50 when the spindle unit 10 is replaced for changeover.

Figure 8:
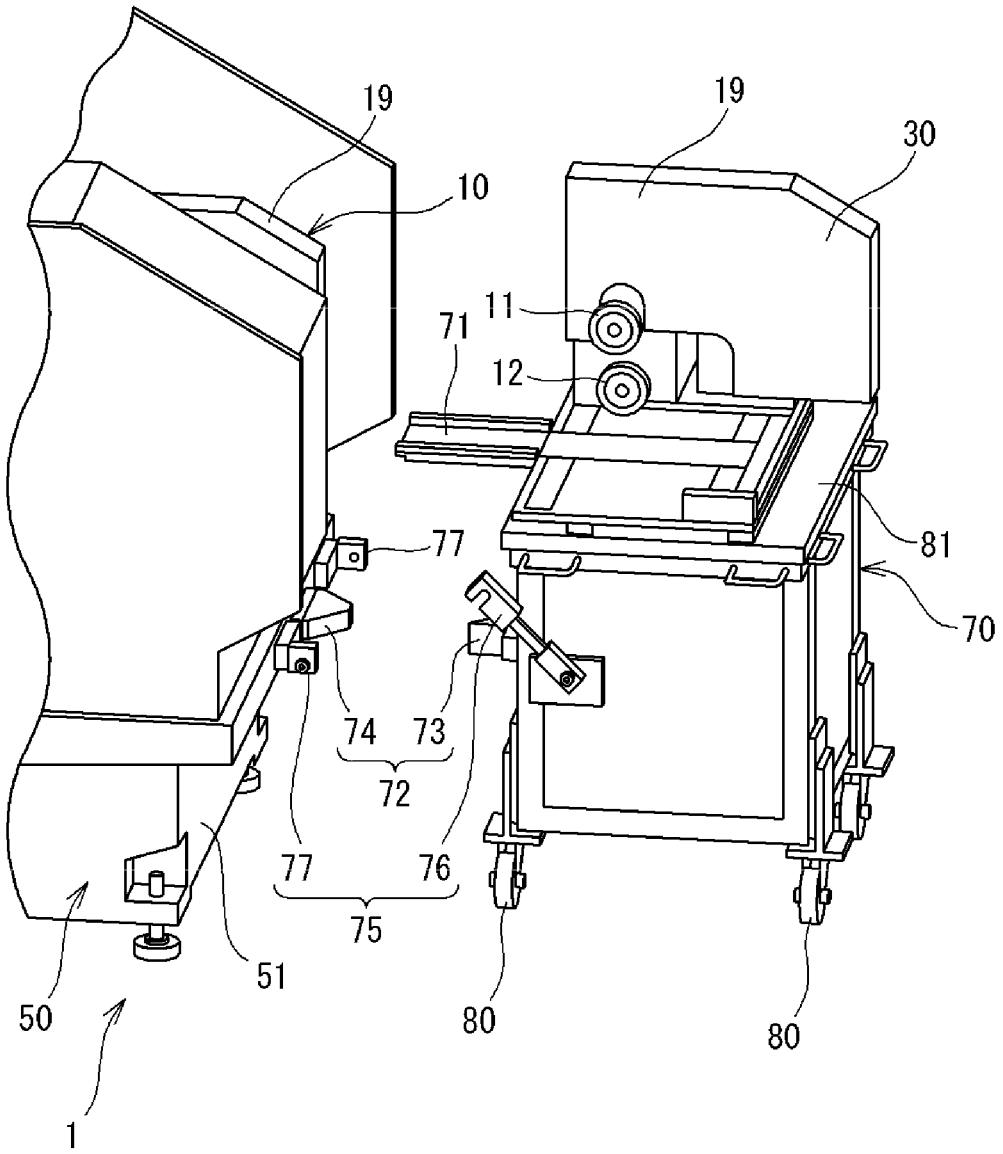
FIG. 8 is an illustration of the changeover cart.

FIG. 8 is an illustration of the changeover cart 70. The machining device 1 includes the changeover cart 70. The changeover cart 70 has wheels 80 and thus can be moved independently. While the first spindle unit 10 mounted on the device base 50 is machining the workpiece W, positioning adjustment of the second spindle unit 30 mounted on the changeover cart 70, such as adjustment of the positions, tilts, etc. of the components like the upper and lower rolls 11, 12, is made for changeover to the subsequent workpiece W of a different bearing number. The cover 19 is removed when the positioning adjustment is made.

Since the changeover cart 70 can be moved independently, this positioning adjustment can be made in a place far from the device base 50, where high workability is ensured. The changeover cart 70 is connected to the device base 50 when changeover is carried out (see FIG. 3). As shown in FIG. 3, the first spindle unit 10 moved along the rail portion 54 and detached from the device base 50 can be mounted on the changeover cart 70, and the second spindle unit 30 different from the first spindle unit 10 can also be mounted on the changeover cart 70.

As shown by arrow G1 in FIG. 3, the first spindle unit 10 is detached from the device base 50 and mounted on the changeover cart 70. Subsequently, as shown by arrow G2 in FIG. 3, the second spindle unit 10 is moved from the changeover cart 70 onto the device base 50. The spindle units 10, 30 have the same configuration (although the positions of the components such as the rolls 11, 12 are different between the spindle units 10, 30 as the positioning adjustment is made). As described above, the first spindle unit 10 can be detached from the device base 50 by moving the first spindle unit 10 along the rail portion 54 having the dovetail groove 55. The second spindle unit 30 can also be mounted at a predetermined position on the device base 50 by moving the second spindle unit 30 along the rail portion 54.

The changeover cart 70 has a connection rail 71 that connects a body 81 of the changeover cart 70 to the device base 50 (device stand 51) as shown in FIGS. 3 and 8 in order to replace the spindle unit 10 with the spindle unit 30. The connection rail 71 can be located on the extension of the rail portion 54 when in use. The spindle units 10, 30 can be switched by operating the lifting mechanism 35 (see FIGS. 1 and 4) and moving the spindle units 10, 30 along the connection rail 71. The connection rail 71 can be folded downward for storage when not in use.

In order to place the connection rail 71 on the extension of the rail portion 54 as described above, the changeover cart 70 is fixed at a predetermined position to the device base 50. The machining device 1 (see FIG. 8) further includes a positioning mechanism 72 and a fixing mechanism 75. The positioning mechanism 72 positions the changeover cart 70 with respect to the device base 50. The fixing mechanism 75 fixes the changeover cart 70 to the device base 50.

Figure 9:
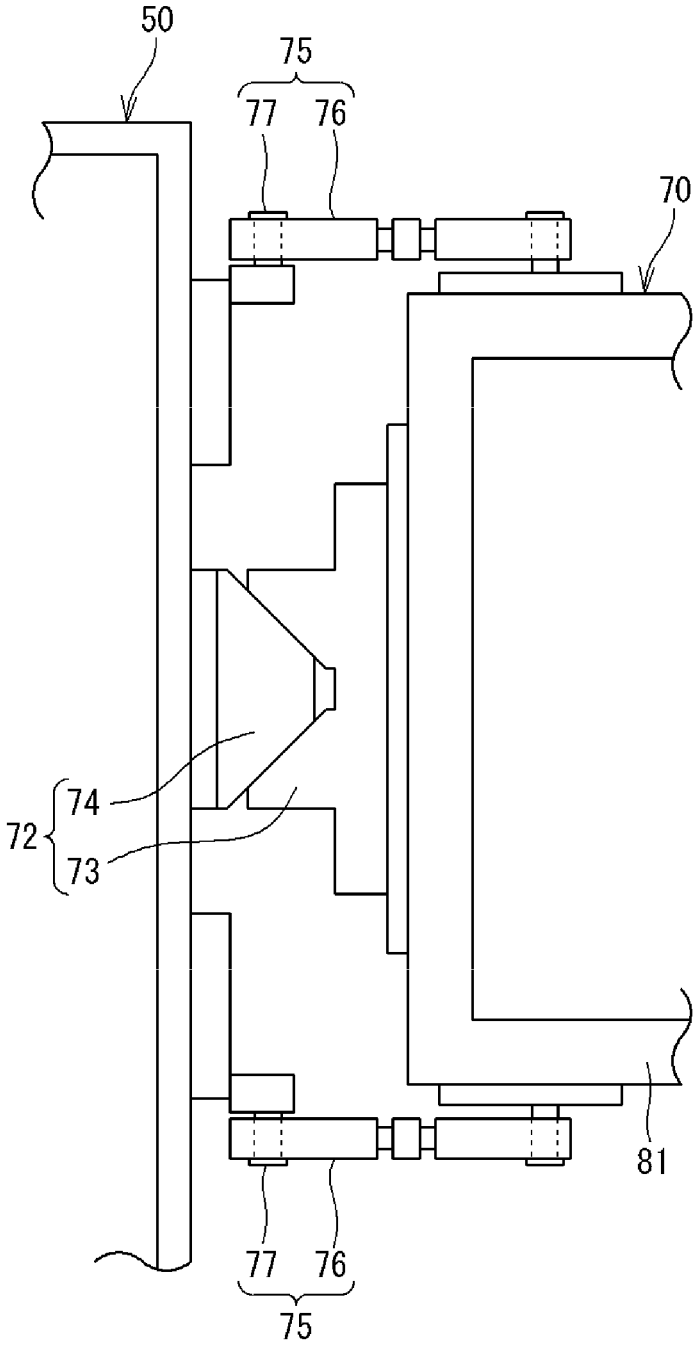
FIG. 9 is an illustration of a positioning mechanism and a fixing mechanism as viewed from above.
Figure 10:
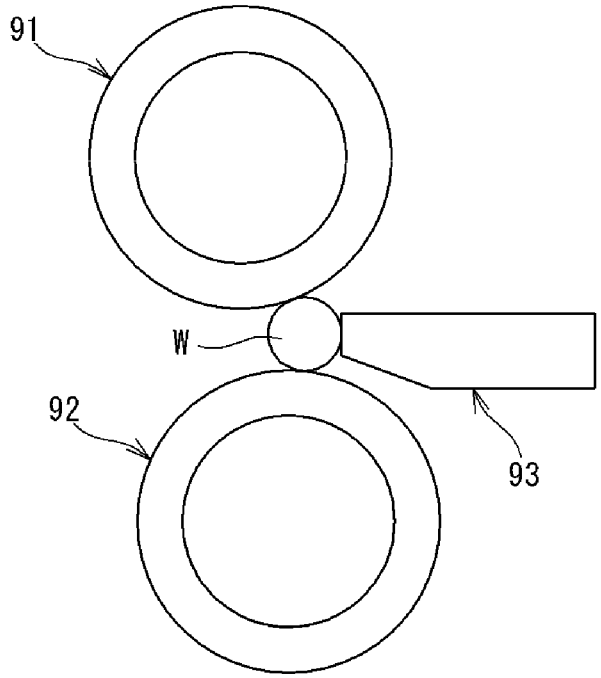
FIG. 10 is an illustration showing the general configuration of a conventional spindle mechanism.

FIG. 9 is an illustration of the positioning mechanism 72 and the fixing mechanism 75 as viewed from above. The positioning mechanism 72 has a recessed fitting portion 73 and a projecting fitting portion 74. Movement in the right-left direction of the changeover cart 70 is restricted when the projecting fitting portion 74 is fitted in the recessed fitting portion 73. In the present embodiment, the recessed fitting portion 73 is fixed to the changeover cart 70, and the projecting fitting portion 74 is fixed to the device base 50. The changeover cart 70 is moved toward the device base 50 so that the recessed fitting portion 73 is fitted on the projecting fitting portion 74, and in this state, the connection rail 71 can be located on the extension of the rail portion 54.

With the recessed fitting portion 73 and the projecting fitting portion 74 being fitted together, the changeover cart 70 is fixed to the device base 50 by the fixing mechanism 75. The fixing mechanism 75 has a hook 76 and a projection 77 that can be engaged with the hook 76. The changeover cart 70 is not allowed to move relative to the device base 50 in the front-rear direction when the hook 76 is engaged with the projection 77. In the present embodiment, the fixing mechanism 75 has two sets of the hooks 76 and the projections 77. The two sets of the hooks 76 and the projections 77 are placed on both the right and left sides of the positioning mechanism 72.

According to the machining device 1 having the above configuration, the first spindle unit 10 mounted on the device base 50 machines the workpiece W. While the first spindle unit 10 is machining the workpiece W, positioning adjustment of another spindle unit, or the second spindle unit 30 placed on the changeover cart 70, such as adjustment of the positions, tilts, etc. of the components like the upper and lower rolls 11, 12, can be made for a workpiece W of the subsequent bearing number. When changeover is carried out, the changeover cart 70 is positioned with respect to the device base 50 and fixed to the device base 50 by the positioning mechanism 72 and the fixing mechanism 75. The first spindle unit 10 mounted on the device base 50 can thus be moved onto the changeover cart 70, and the adjusted second spindle unit 30 mounted on the changeover cart 70 can be moved onto the device base 50. Changeover is thus facilitated. When changeover between workpieces W is carried out, the spindle unit 10 on the device base 50 is replaced with the spindle unit 30 in this manner. Machining can thus be quickly resumed for the workpiece W of the subsequent bearing number.

The device base 50 of the present embodiment (FIG. 1) has the rail portion 54 having the dovetail groove 55, and the clamp 56. The guided portion 22 of the spindle unit 10 is shaped to project so as to correspond to the shape of the dovetail groove 55 and can be moved along the rail portion 54. The clamp 56 has a configuration that can fix the guided portion 22 to the rail portion 54 with the guided portion 22 being located at the predetermined position on the rail portion 54 and that can release the guided portion 22 from the rail portion 54. In this configuration, when the guided portion 22 is released from the rail portion 54 by the clamp 56, the spindle unit 10 can be moved along the rail portion 54 having the dovetail groove 55. This facilitates replacement of the spindle unit 10. With the guided portion 22 being fixed to the rail portion 54 by the clamp 56, the spindle unit 10 (30) is fixed to the device base 50. In this state, the spindle unit 10 (30) can grind the workpiece W.

With the lifting mechanism 35, even if the spindle unit 10 (30) is heavy, the spindle unit 10 (30) can be easily moved along the rail portion 54 as the ball support portion 41 is in rolling contact with the rail portion 54. This further facilitates replacement of the spindle unit 10 (30). As described above with reference to FIGS. 5 and 6, the use of the connector structure (J1) facilitates connection and disconnection of the electrical wiring, etc. between the spindle unit 10 and the device base 50. As a result, the operation stop time of the machining device 1 for changeover (changeover time) is reduced, which leads to improvement in productivity.

The embodiment disclosed above is by way of example in all respects and is not restrictive. That is, the machining device of the present invention is not limited to the illustrated embodiment and may be embodied in other forms without departing from the spirit and scope of the present invention. The present invention is applicable to machining devices having a spindle unit including a spindle that rotates a supported workpiece. In particular, the present invention is effectively applicable to the case where adjustment of members of the spindle unit is required for changeover to a workpiece to be machined. For example, the present invention is applicable to a two-shoe device including a magnet chuck or a diaphragm chuck, or various other devices. The present invention is not limited to this and may be applied to machining devices including a spindle unit that rotates a member (tool) for machining a workpiece. For example, the present invention may be applied to a lathe, a milling machine, a drilling machine, a grinding machine using a grinding wheel, etc. The above embodiment is described with respect to the machining device that grinds a workpiece. However, the present invention may be applied to machining devices that perform other machining such as polishing and cutting. The workpiece is not limited to the one described in the above embodiment and may be other workpieces.

According to the present invention, when changeover between workpieces is carried out, the spindle unit on the device base is replaced with another spindle unit. Machining can thus be quickly resumed for a workpiece of the subsequent bearing number. As a result, the operation stop time of the machining device 1 is reduced, which leads to improvement in productivity.

What is claimed is:

1. A machining device, comprising:

a spindle unit including a spindle for machining a workpiece; and a device base, on which the spindle unit is mounted, wherein the spindle unit is detachably mounted on the device base, the device base has a groove, and the spindle unit has a guided portion that is shaped to project so as to correspond to a shape of the groove and that is movable along the groove.

2. The machining device according to claim 1, wherein the spindle unit includes a roll that rotates the workpiece by contacting the workpiece, a rotary shaft that rotates integrally with the roll and serves as the spindle, and a support member that supports the workpiece, and the spindle unit, a drive source that rotates the rotary shaft, and a grindstone to be brought into contact with the workpiece are mounted on the device base.

3. The machining device according to claim 2, wherein the device base has a rail portion including the groove, and a clamp having a configuration to fix the guided portion to the rail portion with the guided portion being located at a predetermined position on the rail portion and to release the guided portion from the rail portion.

4. The machining device according to claim 3, further comprising:

a lifting mechanism that lifts the guided portion within the groove using air, wherein the lifting mechanism further has a ball support portion that supports the floating guided portion while being in rolling contact with the rail portion.

5. The machining device according to claim 4, further comprising:

a changeover cart to which the spindle unit is mountable and which is moved independently with respect to the device base;

a positioning mechanism that positions the changeover cart with respect to the device base for transferring the spindle unit between the changeover cart and the device base; and a fixing mechanism that fixes the changeover cart to the device base.

6. The machining device according to claim 3, further comprising:

a changeover cart to which the spindle unit is mountable and which is moved independently with respect to the device base;

a positioning mechanism that positions the changeover cart with respect to the device base for transferring the spindle unit between the changeover cart and the device base; and a fixing mechanism that fixes the changeover cart to the device base.

7. The machining device according to claim 2, further comprising:

a changeover cart to which the spindle unit is mountable and which is moved independently with respect to the device base;

a positioning mechanism that positions the changeover cart with respect to the device base for transferring the spindle unit between the changeover cart and the device base; and a fixing mechanism that fixes the changeover cart to the device base.

8. The machining device according to claim 7, wherein the device base has a power supply-side device and a first connector that is connected to the power supply-side device via an electrical wire, and the spindle unit has a second connector that is attachable to and detachable from the first connector, and an electrical device that is connected to the second connector via an electrical wire.

9. The machining device according to claim 2, wherein the device base has a power supply-side device and a first connector that is connected to the power supply-side device via an electrical wire, and the spindle unit has a second connector that is attachable to and detachable from the first connector, and an electrical device that is connected to the second connector via an electrical wire.

10. The machining device according to claim 1, wherein the device base has a rail portion including the groove, and a clamp having a configuration to fix the guided portion to the rail portion with the guided portion being located at a predetermined position on the rail portion and to release the guided portion from the rail portion.

11. The machining device according to claim 10, further comprising:

a lifting mechanism that lifts the guided portion within the groove using air, wherein the lifting mechanism further has a ball support portion that supports the floating guided portion while being in rolling contact with the rail portion.

12. The machining device according to claim 11, further comprising:

a changeover cart to which the spindle unit is mountable and which is moved independently with respect to the device base;

a positioning mechanism that positions the changeover cart with respect to the device base for transferring the spindle unit between the changeover cart and the device base; and a fixing mechanism that fixes the changeover cart to the device base.

13. The machining device according to claim 11, wherein the device base has a power supply-side device and a first connector that is connected to the power supply-side device via an electrical wire, and the spindle unit has a second connector that is attachable to and detachable from the first connector, and an electrical device that is connected to the second connector via an electrical wire.

14. The machining device according to claim 10, further comprising:

a changeover cart to which the spindle unit is mountable and which is moved independently with respect to the device base;

a positioning mechanism that positions the changeover cart with respect to the device base for transferring the spindle unit between the changeover cart and the device base; and a fixing mechanism that fixes the changeover cart to the device base.

15. The machining device according to claim 14, wherein the device base has a power supply-side device and a first connector that is connected to the power supply-side device via an electrical wire, and the spindle unit has a second connector that is attachable to and detachable from the first connector, and an electrical device that is connected to the second connector via an electrical wire.

16. The machining device according to claim 10, wherein the device base has a power supply-side device and a first connector that is connected to the power supply-side device via an electrical wire, and the spindle unit has a second connector that is attachable to and detachable from the first connector, and an electrical device that is connected to the second connector via an electrical wire.

17. The machining device according to claim 1, further comprising:

a changeover cart to which the spindle unit is mountable and which is moved independently with respect to the device base;

a positioning mechanism that positions the changeover cart with respect to the device base for transferring the spindle unit between the changeover cart and the device base; and a fixing mechanism that fixes the changeover cart to the device base.

18. The machining device according to claim 17, wherein the device base has a power supply-side device and a first connector that is connected to the power supply-side device via an electrical wire, and the spindle unit has a second connector that is attachable to and detachable from the first connector, and an electrical device that is connected to the second connector via an electrical wire.

19. The machining device according to claim 1, wherein the device base has a power supply-side device and a first connector that is connected to the power supply-side device via an electrical wire, and the spindle unit has a second connector that is attachable to and detachable from the first connector, and an electrical device that is connected to the second connector via an electrical wire.

20. A machining device, comprising:

a spindle unit including a spindle for machining a workpiece; and a device base, on which the spindle unit is mounted, the device base including a clamp configured to fix the spindle unit to the device base and to release the spindle unit from the device base, wherein the spindle unit is detachably mounted on the device base.

21. A machining system, comprising:

a spindle unit including a spindle for machining a workpiece;

a device base, on which the spindle unit is mounted, the spindle unit being detachably mounted on the device base;

a changeover cart to which the spindle unit is mountable and which is moved independently with respect to the device base;

a positioning mechanism that positions the changeover cart with respect to the device base for transferring the spindle unit between the changeover cart and the device base; and a fixing mechanism that fixes the changeover cart to the device base.

* * * * *